United States Patent [19]

Johnson

[11] Patent Number: 4,773,604

[45] Date of Patent: Sep. 27, 1988

[54] SEAT MEMBER FOR GYRATORY ROCK CRUSHER BOWLS

[76] Inventor: Louis W. Johnson, 2435 Prairie Rd., Eugene, Oreg. 97402

[21] Appl. No.: 73,917

[22] Filed: Jul. 13, 1987

Related U.S. Application Data

[63] Continuation of Ser. No. 865,650, May 16, 1986, abandoned, which is a continuation of Ser. No. 685,209, Dec. 24, 1984, abandoned, which is a continuation of Ser. No. 422,020, Sep. 23, 1982.

[51] Int. Cl.[4] ..... B02C 2/00

[52] U.S. Cl. ..... 241/207; 241/101.2

[58] Field of Search ..... 241/207–216, 241/300, 101.2; 308/241, 243, 245, 3 S, 5 R, 78.1, 183, 187

[56] References Cited

U.S. PATENT DOCUMENTS 3,582,008 6/1971 Motz et al. ..... 241/207 X
4,192,472 3/1980 Johnson .

FOREIGN PATENT DOCUMENTS 757487 1/1953 United Kingdom .
982795 10/1965 United Kingdom .
1202689 8/1970 United Kingdom .
1260960 1/1972 United Kingdom .

*Primary Examiner*—Howard N. Goldberg
*Assistant Examiner*—Joseph M. Gorski
*Attorney, Agent, or Firm*—Shlesinger Arkwright & Garvey

[57] ABSTRACT

An annular seat member is supported between an annular base member and a load receiving member. The seat member is tapered toward its upper end and projects into an inverted V-shaped recess in the load receiving member. The tapered surfaces of the seat member have a plurality of annular grooves. Inserts are mounted in projecting relation from these grooves and are formed of a material which provides a long wearing bearing surface with the metal of the load receiving member.

2 Claims, 1 Drawing Sheet

SEAT MEMBER FOR GYRATORY ROCK CRUSHER BOWLS

This application is a continuation, of application Ser. No. 865,650, filed May 16, 1986, now abandoned in turn a continuation of Ser. No. 685,209, filed Dec. 24, 1984, now abandoned in turn a continuation of Ser. No. 422,020, filed Sept. 23, 1982 now abandoned.

BACKGROUND OF THE INVENTION

This invention relates to new and useful improvements in a seat member for gyratory rock crusher bowls.

In my U.S. Pat. No. 4,192,472 relating to a gyratory-type rock crusher, a separate seat member is provided between the bowl of the crusher and the base for minimizing shock forces between these members and furthermore to provide a convenient method for the renewal of the support for the bowl. Because of the violent metal to metal contact resulting from the action of a gyratory-type crusher, mating metal surfaces of the seat with the bowl sometimes produce undesirable wear such as cold welding, gouging and cratering. This requires substantial machining, replacement, or other methods for renewing these bearing surfaces.

SUMMARY OF THE INVENTION

According to the present invention and forming a primary objective thereof, a seat member is provided for gyratory rock crusher bowls which eliminates metal to metal contact and consequent undesirable wear, which is capable of bearing heavy off-center thrust loads between the bowl and the base member, and which is readily and inexpensively renewed when worn.

A more particular object of the invention is to provide insert means mounted in grooves in the seat member which project from the grooves so as to maintain a low friction contact between the seat member and the rock crusher bowl, and furthermore to provide such insert means which are readily removable and replaceable for renewing the bearing surface.

In carrying out the function of the invention in association with a gyratory type rock crusher, the seat member is annular in configuration and is supported on the annular base of the rock crusher. The bowl of the crusher is supported on the seat member. The bowl has a downwardly facing groove and the seat member has upwardly facing surfaces arranged to project into the groove of the load receiving member. These upwardly facing surfaces have grooves arranged to receive inserts which provide a long wearing bearing surface with the metal of the bowl. The inserts are of a thickness greater than the depth of their grooves and thus project from the grooves so as to bear against opposite walls of the groove in the bowl to maintain the latter in a low friction supported relation.

The invention will be better understood and additional objects and advantages will become apparent from the following description taken in connection with the accompanying drawing.

DETAILED DESCRIPTION OF A PREFERRED EMBODIMENT

Figure 2:
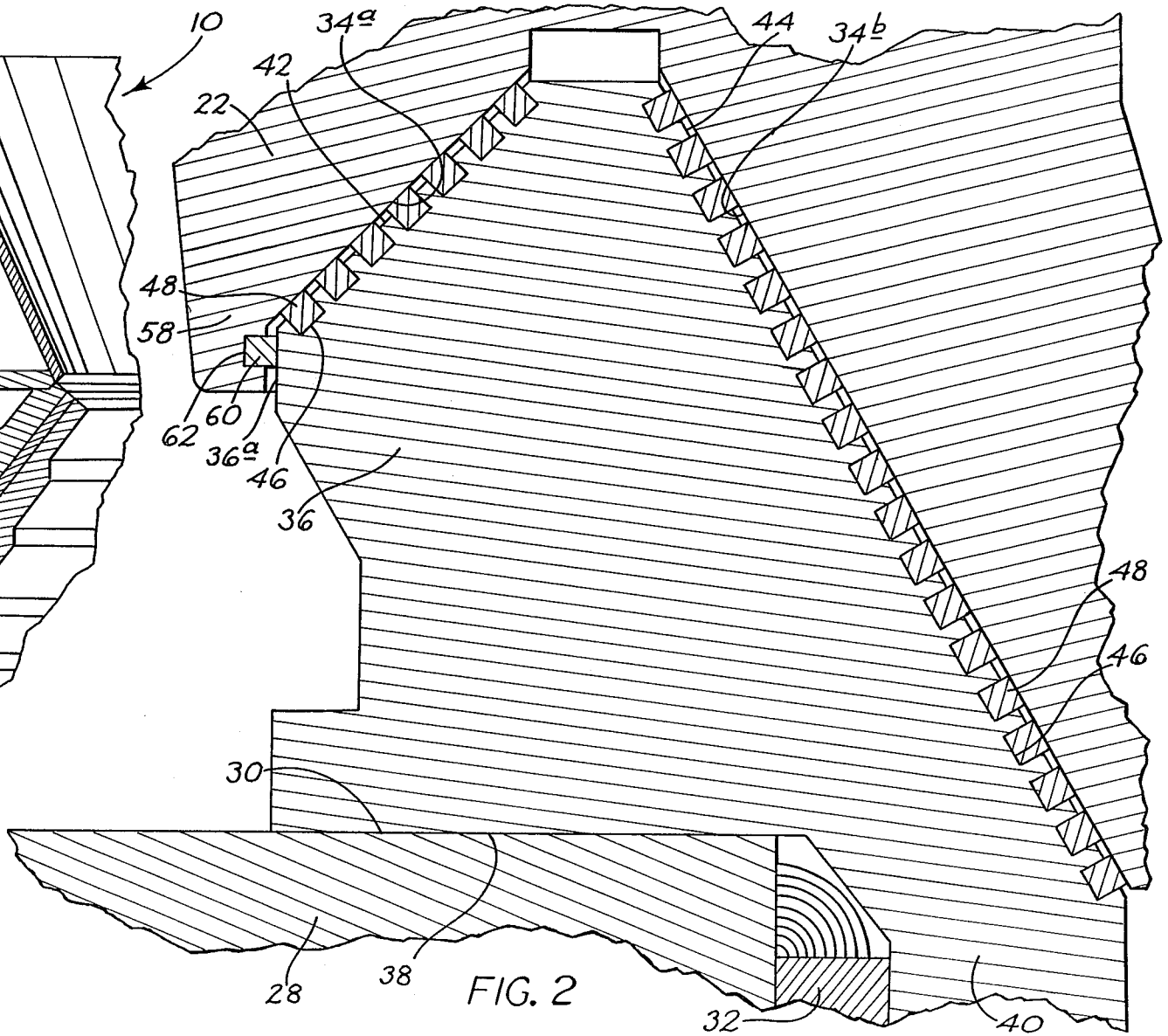
FIG. 2 is a cross sectional view similar to FIG. 1 but greatly enlarged in scale and showing details of the invention.
Figure 1:
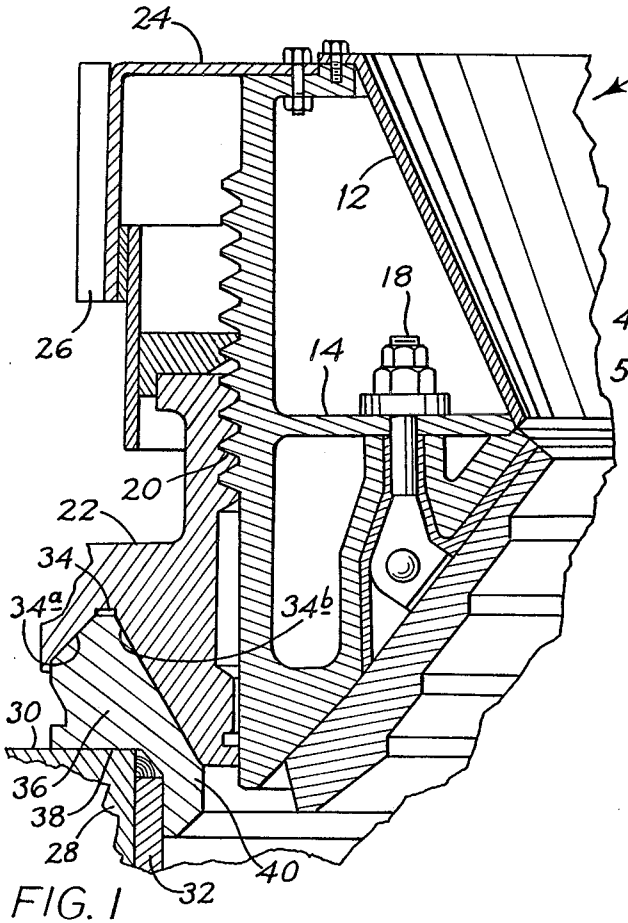
FIG. 1 is a cross sectional view of a portion of a gyratory rock crusher and showing a seat member therein to which the concept of the invention may be applied.

With reference to the drawings and particularly to FIG. 1, a gyratory rock crusher has an annular bowl 10 with a hopper portion 12 and an inturned flange 14 below its upper edge which supports a liner by means of eyebolts 18 in a conventional manner. The liner is associated with a crusher head and other mechanism, not shown, operative in gyratory rock crusher functions. Bowl 10 has a vertical threaded connection 20 with a bowl nut 22 and includes a top angular housing 24 bolted thereto, the periperal portion of such housing having evenly spaced vertical projections or lugs 26 secured thereon which are engageable by power rotating means not shown.

The bowl nut 22 is a heavy duty annular member and is the load transfer connection between the inner crusher parts and the annular base 28 of the crusher. Base 28 has a top surface 30 and an integral vertical inner wall 32. Nut 22 has an annular inverted V-shaped groove 34 on its undersurface defined by opposed tapered walls **34*a* and 34*b*, the latter wall being substantially longer than wall 34*a* and being disposed inwardly of the crusher from wall 34*a*. An annular seat member 36 has a flat bottom surface portion 38 freely supported on the surface 30 of the crusher base, and a depending flange portion 40 thereof projects down along the inner surface of the crusher wall 32. The upper portion of the seat member 36 is tapered, having angled surfaces 42 and 44 assuming substantially the same configuration as the inverted V-shaped defining surfaces 34*a* and 34*b*, respectively, of the groove 34** in the bowl nut.

According to the invention, the surfaces 42 and 44 are provided with parallel annular grooves 46 which receive bar inserts 48 of a material that provides a durable wearing bearing surface with the metal of the bowl nut. The inserts 48 are of a dimension to project a short distance beyond the surfaces 42 and 44 and thus maintain the metal surfaces **34*a* and 34*b* of the bowl nut off the metal surfaces 42 and 44 of the seat member. In a preferred construction, inserts 48** are square and the grooves have a width equal to the dimension of one side of the inserts. Such grooves are shallower however so that the inserts will project therefrom. In installation, the inserts can be installed with any side out.

Figure 3:
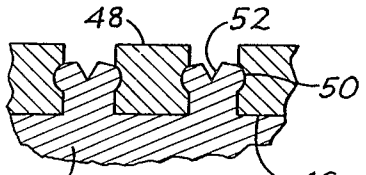
FIG. 3 is an enlarged fragmentary sectional view showing structure for locking the inserts in their grooves.

End to end compression holds the inserts in place on surface 44 since the latter is an inside curve. To prevent springing out of the inserts on surface 42 when the bowl nut 22 lifts off the seat member 36, referring to FIG. 3, portions of the walls between the grooves 46 at spaced points around the seat member are provided with distortions 50, such as by making chisel grooves 52 in the walls between the grooves, so as to bite slightly into these inserts and maintain them in place. While this bite will assist in holding the inserts in place, the inserts can be forcefully pulled from the grooves for replacement and new ones forced into place past the distortions 50. Adhesive may also possibly be used on both surfaces if desired.

The material used for the inserts can be any material that provides a low friction bearing surface with the metal of the bowl nut. That is, the bowl nut is formed of a ferrous material and the inserts are formed of a non-ferrous material such as bronze and preferably a non-metallic material such as a hard plastic. The plastic may comprise Delrin or Nylon or a plastic of equivalent or better shock and wear characteristics. It may also be desirable to use bronze inserts on one of the surfaces 42 or 44 and plastic inserts on the other. With the surface 44 substantially longer than the surface 42, the use of plastic inserts on the surface 44 and bronze inserts on the surface 42 is an efficient and yet inexpensive arrangement.

The inserts 48 thus reduce the friction of movement that occurs in the movable support of the bowl nut 22 on the base of the crusher and thus prevent any substantial wear and eliminates cold welding, cratering and fretting from occurring between metal surfaces. The bowl nut 22 and the seat member 36 themselves do not require replacement or repair since it is merely necessary to replace the inserts when worn. The plurality of grooves and inserts form multiple cooperating shoulder engagement therebetween to resist lateral displacement of the inserts which may result from heavy load forces between the member 36 and the load receiving member 22. In addition to providing substantial permanent life of the bowl nut and base, as well as the seat member, the inserts allow for slight distortion or movement of the bowl nut and seat member and thus this joint absorbs damaging distortional and impacting forces in the machine.

Lateral stability and stationary placement of the bowl on the seat member 36 are maintained by the shape of the engaging parts 22 and 36 and also by a depending flange 58 on the bowl nut 22 which is horizontally aligned with a vertical outer edge **36*a* of the seat member. By extending the concept of the invention an insert 60 of a material similar to that described for inserts 48 is inserted in a groove 62 in the flange 58** and projects from such groove for engagement with the seat member to prevent metal to metal contact.

It is to be understood that the form of my invention herein shown and described is to be taken as a preferred example of the same and that various changes in the shape, size and arrangement of parts may be resorted to without departing from the spirit of my invention, or the scope of the subjoined claims. Although the invention has novel and particular use in combination with a gyratory rock crusher, it is to be understood that the concept thereof may have application in other structures as well, namely, in bearing areas where metal parts ordinarily have mating engagement.

Having thus described my invention, I claim:

1. A rock crusher comprising:

(a) an annular base member;

(b) an annular seat member supported on said base member;

(c) an annular thread ferrous bowl nut supported on said seat member in a substantially non-slidable support and arranged to support a hopper portion;

(d) said seat member comprising an upright body portion having a lower surface seated on said base member and also having opposite sides;

(e) said bowl nut having a downwardly facing inverted V-shaped recess defined by oppositely extending and diverging ferrous surfaces;

(f) said body portion having a pair of upwardly facing converging surfaces on the sides thereof projecting into said V-shaped recess;

(g) said upwardly facing surfaces having a plurality of parallel spaced annular substantially rectangular in cross-section grooves extending a selected depth into said body portion and having parallel longitudinal defining walls;

(h) an individual substantially rectangular in cross-section non-ferrous bar insert cooperating with said grooves and extending longitudinally in each of said annular grooves engageably confined between said parallel longitudinal defining walls and providing a low friction bearing surface with said bowl nut;

(i) said walls having distorted portions;

(j) said distorted portions projecting into said grooves for holding said inserts in said grooves;

(k) said inserts having a substantially rectangular in cross-section portion projecting a substantial distance from said grooves to form a plurality of elongated individual top surfaces which are substantially spaced from each other and lie substantially in a single plane adjacent any one of said pair of converging surfaces and which bear individually against the ferrous surface of said V-shaped recess and maintain the bowl nut in a reduced friction support relation with said body portion;

(l) said substantially rectangular in cross-section portions of said inserts projecting from said grooves cooperating with each other to form a series of parallel substantially rectangular in cross-section recesses offset from said spaced annular substantially rectangular in cross-section grooves, and providing open spaces between respective portions of said inserts;

(m) said plurality of grooves and inserts forming multiple cooperating shoulder engagements therebetween to resist lateral displacement of said inserts which may result from heavy load forces between said seat member and said bowl nut; and (n) said V-shaped recess and the upwardly facing surfaces which project thereinto forming a substantially laterally stable connection between said body portion and said bowl nut.

2. The rock crusher of claim 1 wherein said body portion includes a surface on one side extending substantially vertically down from one of said upwardly facing surfaces, and said bowl nut includes a flange having a substantially vertical surface in overlapping, spaced, parallel relation with the vertical surface of said body portion, one of said vertical surfaces having a groove therein, and an insert mounted in said latter groove formed of a material providing a low friction bearing surface with the other vertical surface, said insert having a thickness dimension such that when seated in said groove it projects from said groove to bear against said other surface and assist in said lateral support in a reduced friction engagement between said body portion and said bowl nut.

* * * * *